US009491814B1

(12) United States Patent
Stefanoff

(10) Patent No.: US 9,491,814 B1
(45) Date of Patent: Nov. 8, 2016

(54) SYSTEMS, DEVICES, AND METHODS FOR INFINITE DIMMING OF SEMICONDUCTOR LIGHTS

(71) Applicant: Buddy Stefanoff, Owasso, OK (US)

(72) Inventor: Buddy Stefanoff, Owasso, OK (US)

( * ) Notice: Subject to any disclaimer, the term of this patent is extended or adjusted under 35 U.S.C. 154(b) by 0 days.

(21) Appl. No.: 14/514,352

(22) Filed: Oct. 14, 2014

Related U.S. Application Data

(60) Provisional application No. 61/890,377, filed on Oct. 14, 2013.

(51) Int. Cl.
*H05B 33/08* (2006.01)

(52) U.S. Cl.
CPC ..... *H05B 33/0806* (2013.01); *H05B 33/0815* (2013.01); *H05B 33/0845* (2013.01); *H05B 33/0851* (2013.01)

(58) Field of Classification Search
None
See application file for complete search history.

(56) References Cited

U.S. PATENT DOCUMENTS

| | | | | |
|---|---|---|---|---|
| 6,020,689 | A * | 2/2000 | Gradzki et al. | 315/224 |
| 6,043,611 | A * | 3/2000 | Gradzki et al. | 315/194 |
| 6,175,195 | B1 * | 1/2001 | Janczak et al. | 315/194 |
| 8,299,724 | B2 * | 10/2012 | Huynh | H05B 33/083 315/291 |
| 2013/0271040 | A1 * | 10/2013 | Chen et al. | 315/307 |
| 2013/0342122 | A1 * | 12/2013 | Sawada | 315/200 R |
| 2013/0342129 | A1 * | 12/2013 | Vaughan | 315/240 |

* cited by examiner

*Primary Examiner* — Vibol Tan
(74) *Attorney, Agent, or Firm* — John M. Behles

(57) ABSTRACT

Infinite dimming circuits, devices, systems, and methods of use are provided herein. In one embodiment, a dimming driver integrated circuit (IC) is configured to compensate for flicker caused by alternating current (AC) waveform valleys of an operational reference provided by an AC source, the dimming driver IC having a main interface and a secondary interface, the main interface receiving the operational reference, the secondary interface receiving a compensating reference which is relative to the operational reference, the dimming driver IC using both the operational reference and the compensating reference to create a compensated waveform that drives the semiconductor light while removing flicker at any luminance level.

18 Claims, 6 Drawing Sheets

SYSTEMS, DEVICES, AND METHODS FOR INFINITE DIMMING OF SEMICONDUCTOR LIGHTS

CROSS REFERENCE TO RELATED APPLICATIONS

This application claims the priority benefit of U.S. Provisional Application Ser. No. 61/890,377, filed on Oct. 14, 2013, titled "SYSTEMS, DEVICES, AND METHODS FOR INFINITE DIMMING OF SEMICONDUCTOR LIGHTS", which is hereby incorporated by reference herein in its entirety, including all references cited therein.

FIELD OF THE PRESENT TECHNOLOGY

The present technology relates generally to semiconductor lighting, and more specifically, but not by way of limitation, to systems and methods that allow for infinite dimming, including deep dimming, of semiconductor lights, such as light emitting diodes (LEDs). In general, these devices and systems use combinations of integrated circuits and control methodologies to prevent flickering of LEDs during low power situations, such as during deep dimming.

SUMMARY

According to some embodiments, the present technology is directed to an infinitely dimmable semiconductor lighting assembly, the assembly comprising: (a) dimming driver integrated circuit (IC) that is configured to compensate for flicker in a semiconductor light caused by alternating current (AC) waveform valleys of an operational reference provided by an AC source, the dimming driver IC comprising: a main interface and a secondary interface, the main interface receiving the operational reference, the secondary interface receiving a compensating reference which is relative to the operational reference, the dimming driver IC using both the operational reference and the compensating reference to create a compensated waveform that drives the semiconductor light while removing flicker at any luminance level; (b) a dimming interface that receives dimming input signals ranging from zero percent lumens to 100 percent lumens of the semiconductor light, the semiconductor light coupled with the dimming driver IC via an output interface of the dimming driver IC; (c) the dimming driver IC is configured to selectively and infinitely control illumination of the semiconductor light from between zero percent lumens to 100 percent lumens, in response to the dimming input signals, in such a way that no flicker is produced by the semiconductor light.

According to some embodiments, the present technology is directed to a method for deep dimming of a semiconductor light, the method comprising: (a) pre-loading a semiconductor light with an initial current from an AC source, wherein the semiconductor light includes: (1) a dimming driver integrated circuit (IC) that is configured to compensate for flicker in the semiconductor light caused by alternating current (AC) waveform valleys of an operational reference provided by the AC source, the dimming driver IC comprising: a main interface and a secondary interface, the main interface receiving the operational reference, the secondary interface receiving a compensating reference which is relative to the operational reference, the dimming driver IC using both the operational reference and the compensating reference to create a compensated waveform that drives the semiconductor light while removing flicker at any luminance level; (b) establishing a luminance reference curve for dimming of the semiconductor light such that the initial current of the power supply is associated with a zero luminance level for the semiconductor light; and (c) outputting signals by the dimming driver integrated circuit that cause the semiconductor light to emit light at any luminance within a range between 0% luminance and 10% luminance, inclusive, without inducing flickering of the semiconductor light.

According to some embodiments, the present technology is directed to a dimming driver integrated circuit (IC) that is configured to compensate for flicker in a semiconductor light caused by alternating current (AC) waveform valleys of an operational reference provided by an AC source, the dimming driver IC comprising: a main interface and a secondary interface; the main interface receiving the operational reference, the secondary interface receiving a compensating reference which is relative to the operational reference; the dimming driver IC using both the operational reference and the compensating reference to create a compensated waveform that drives the semiconductor light while removing flicker at any luminance level.

BRIEF DESCRIPTION OF THE DRAWINGS

Certain embodiments of the present technology are illustrated by the accompanying figures. It will be understood that the figures are not necessarily to scale and that details not necessary for an understanding of the technology or that render other details difficult to perceive may be omitted. It will be understood that the technology is not necessarily limited to the particular embodiments illustrated herein.

DETAILED DESCRIPTION OF EXEMPLARY EMBODIMENTS

Figure 1:
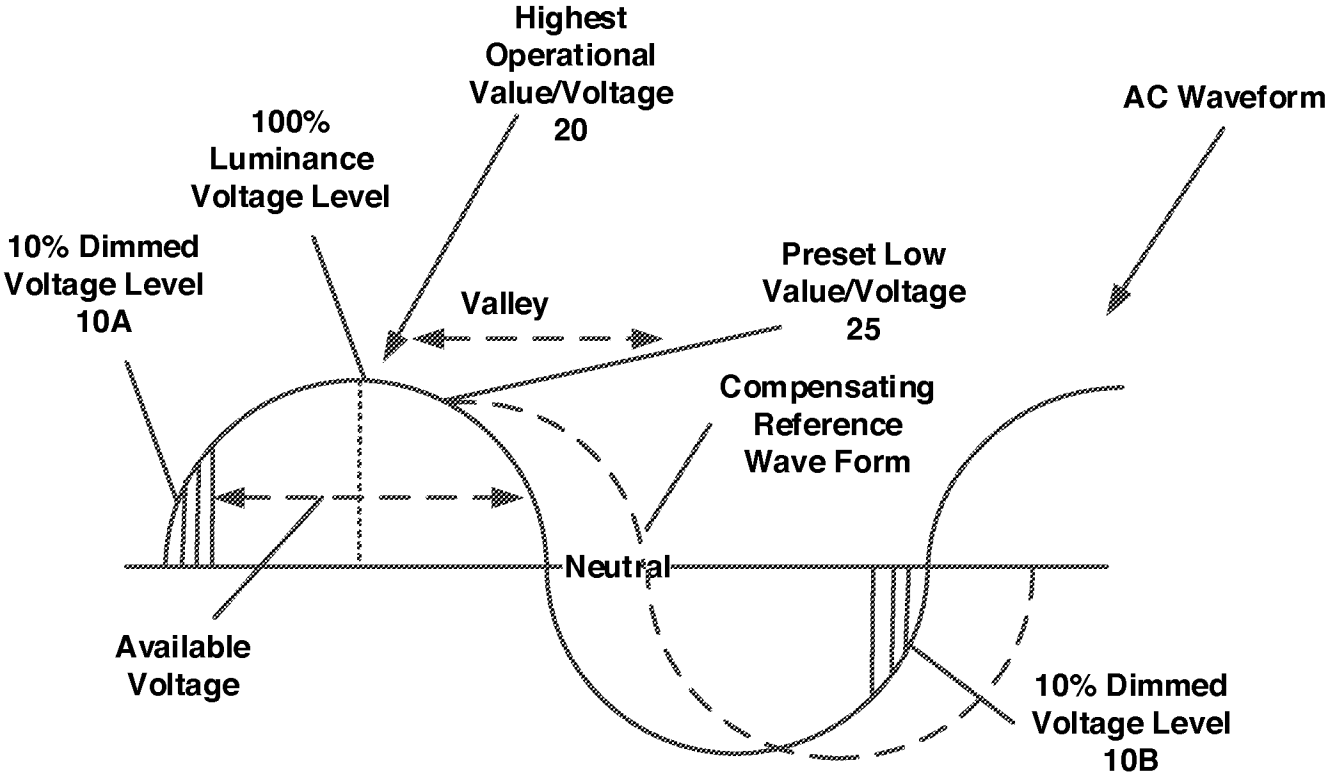
FIG. 1 is a schematic diagram of an example AC waveform used to power a semiconductor light, illustrating chopping of the AC waveform.

While this technology is susceptible of embodiment in many different forms, there is shown in the drawings, and will herein be described in detail, several specific embodiments with the understanding that the present disclosure is to be considered as an exemplification of the principles of the technology and is not intended to limit the technology to the embodiments illustrated.

It will be understood that like or analogous elements and/or components, referred to herein, may be identified throughout the drawings with like reference characters. It will be further understood that several of the figures are merely schematic representations of the present technology. As such, some of the components may have been distorted from their actual scale for pictorial clarity.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" or "according to one embodiment" (or other phrases having similar import) at various places throughout this specification are not necessarily all referring to the same embodiment. Furthermore, the particular features, structures, or characteristics may be combined in any suitable manner in one or more embodiments. Furthermore, depending on the context of discussion herein, a singular term may include its plural forms and a plural term may include its singular form. Similarly, a hyphenated term (e.g., "on-demand") may be occasionally interchangeably used with its non-hyphenated version (e.g., "on demand"), a capitalized entry (e.g., "Software") may be interchangeably used with its non-capitalized version (e.g., "software"), a plural term may be indicated with or without an apostrophe (e.g., PE's or PEs), and an italicized term (e.g., "N+1") may be interchangeably used with its non-italicized version (e.g., "N+1"). Such occasional interchangeable uses shall not be considered inconsistent with each other.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It is noted at the outset that the terms "coupled," "connected," "connecting," "electrically connected," etc., are used interchangeably herein to generally refer to the condition of being electrically/electronically connected. Similarly, a first entity is considered to be in "communication" with a second entity (or entities) when the first entity electrically sends and/or receives (whether through wireline or wireless means) information signals (whether containing data information or non-data/control information) to the second entity, regardless of the type (analog or digital) of those signals. It is further noted that various figures (including component diagrams) shown and discussed herein are for illustrative purpose only, and are not drawn to scale.

Generally speaking, the present technology may be directed to systems, devices, and methods that provide infinite dimming, including deep dimming, of semiconductor lights, such as an LED. In some instances, the present technology may include improved power supplies that allow for deep dimming, even when providing high power (e.g., ranging from one to more than 100 watts of power) to an LED array. Additionally, the power systems provided herein may provide power to other ancillary devices of an LED assembly, such as cooling modules, and so forth. In some instances, the power supply may provide these relatively high levels of power while remaining small enough to be retrofit into an existing luminaire assembly.

In some instances, the power supplies provided herein may include deep dimming TRIAC power supplies that are configured to provide complete luminance control over an associated LED array, allowing the LED array to emit from zero to 100% luminance without any flickering of the LED at low power levels. More specifically, the power supply may include a dimming driver integrated circuit (IC) that is configured to compensate for AC waveform oscillation, which is especially pronounced during low power utilization. Also, the power supply may be modified to include dual interfaces that provide references to the dimming driver IC on two separate interfaces. One reference includes an operational reference that can be quantified in terms of a voltage and/or current. A second reference includes a compensating reference that can also be quantified in terms of a voltage and/or current. The compensating reference is related to the operational reference and compensates for valleys in the waveform of the operational reference.

In some embodiments the compensating reference can comprise a value that is in-phase from the operational reference. In some embodiments, the compensating reference can be out of phase relative to the operational reference. The compensating reference can be fine tuned to ensure that both flicker and noise are reduced or eliminated. In one instance, the valley detection circuitry can detect valley presence in the operational reference and cause the compensating circuitry to apply a compensating current that is sufficient to "fill" or at least partially fill the valley.

This dual provision of references compensates for noise and mitigates output current fluctuation of the dimming driver IC during low power situations, where flicker would be most noticeable.

Semiconductor lights, which are powered by an AC power source, do not possess the inherent ability to remain illuminated during oscillation of the input AC waveform, as is common with an incandescent light bulb. That is, an incandescent light experiences hysteresis from heating of a filament, which allows the light to remain illuminated during what is referred to as the "valley" of the AC waveform. As is illustrated in FIG. 1, the valley of the AC waveform exists between peaks (positive and negative) of an AC waveform, where the waveform is oscillating from positive to neutral or negative to neutral, the reduction in and eventual lack of voltage causes a semiconductor lighting assembly to switch on and off as the waveform alternates. More specifically, the power supply of the assembly requires an initial voltage to power up sufficiently in order to cause the light to illuminate.

This alternating current induces a flicker in a LED, whereas an incandescent light will remain illuminated due to hysteresis within the filament (which causes illumination for a period of time after electrical current is removed from the filament).

The present technology employs a dimming driver IC that detects valleys within the waveform and compensates for the alternating nature of the AC waveform using, for example, a diode and capacitor combination that stores energy and releases the energy during waveform alternation to reduce LED flicker. This energy that is provided to the circuit is in-phase with the main AC waveform.

Further complications arise when the LED is dimmed to less than 20% luminance, and further when lower than 10%. The dimming driver IC of the present technology is configured to compensate for noise or other deleterious variances in the AC waveform, especially in low power situations, such as when the LED has been dimmed significantly.

FIG. 1 illustrates the effective AC waveform representing a semiconductor light that has been dimmed to less than 10% total luminance. Note that because portions of the AC waveform 10A and 10B, when the LED is dimmed to less than 10% are substantially smaller than portions of the AC waveform at 100% luminance, the size of the valley increases, which causes the power source to switch on and off, causing LED flicker. That is, the power source for an integrated circuit requires an initial amount of reference, voltage or current to prepare the circuit for use. Any reference that is below this initial level may cause the power source to cycle, which in turn causes the LED assembly to flicker on and off.

The use of less than all of the AC waveform is known as chopping of the AC waveform. The portion of the AC waveform that is used, which in this example is 10%, leaves an available voltage of 90%.

Figure 2:
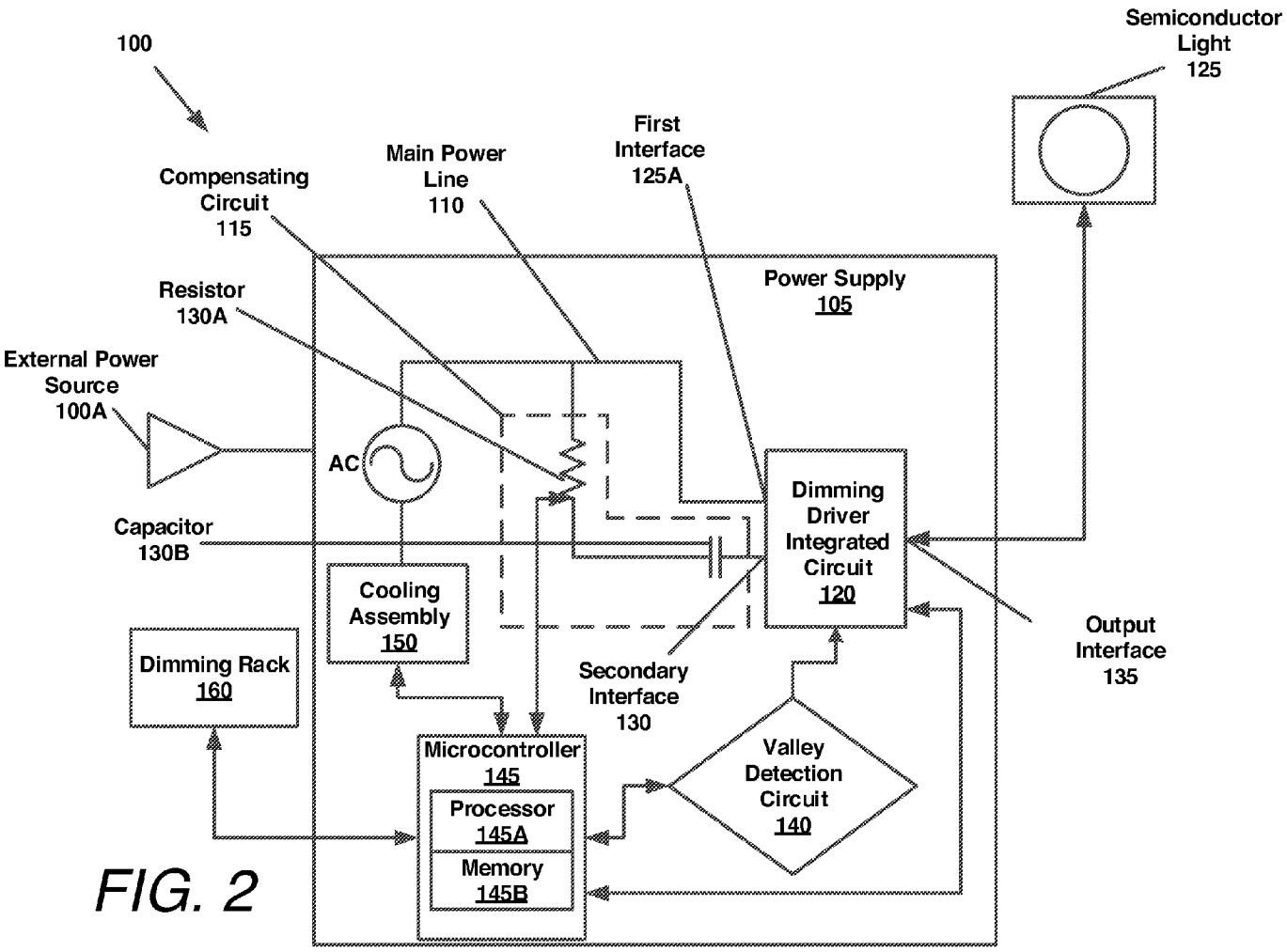
FIG. 2 is a schematic diagram of an example system of the present technology, for use in controlling an example semiconductor lighting assembly.

Any noise within the dimming driver IC may also contribute to resetting of the power supply, which causes the dimming driver IC to reset. Noise may be generated, by example, from an external control system that is used to control the assembly 100 (FIG. 2). To prevent the power supply from switching on and off, the present technology may utilize a power pre-loading sequence, where the power supply is pre-loaded with a set amount of voltage or current (e.g., initial voltage or current) that allows the power supply and constituent components of the assembly 100 to operate. It will be understood that the set amount of pre-loading current may vary according to the requirements of the power supplies, and dimming driver IC utilized, with the semiconductor lights.

In general, a dimming driver module/IC of the present technology is connected with an AC source that provides AC power at a given voltage. Dimming control signals (e.g., input signals) will vary the current provided to the dimming driver module. The dimming driver module of the present technology allows for infinite adjustment of current for dimming of an LED controlled by the dimming driver module.

FIG. 2 illustrates an exemplary semiconductor lighting assembly 100 that includes a power supply 105, a main power line 110, a compensating circuit 115, a dimming driver IC 120, a valley detection circuit 140, a microcontroller 145, and a semiconductor light 125. The power supply 105 receives alternating current from an external energy source 100A, such as a power supply from a building in which the assembly is being utilized. In some instances, the power supply 105 of the assembly 100 is capable of delivering, and will in fact deliver, in excess of 100 watts of power to the semiconductor light 125. The main power line 110 is configured to receive voltage from the power supply 105 and deliver an operating voltage of direct current to the dimming driver IC 120. In some instances, the main power line 110 delivers 12 volts to a first interface 125A of the dimming driver IC 120.

The compensating circuit 115 may include a resistor 130A that is coupled with the main power line 110. The resistor 130A is placed in parallel with a capacitor 130B that stores energy that is delivered to the dimming driver IC 120, as will be described in greater detail below. The compensating circuit 115 provides the compensating reference to the dimming driver IC 120 that is substantially the same magnitude as the operational reference that is required to cause the semiconductor lighting assembly 100 to output light in a dimmed manner (e.g., less than 100%). Again, the compensating reference is related to the operational reference and is in-phase relative to the operational reference to some degree. The magnitude of the compensating reference can be selectively adjusted by the resistor 130A. That is, the resistor 130A can be controlled by the microcontroller 145 in order to cause the capacitor 130B to discharge the compensating reference at a desired rate. The magnitude of the compensating reference is determined, at least in part, by evaluation of the AC waveform of the operational reference by the valley detection circuitry 140. In one embodiment, the resistor 130A is a potentiometer or a variable resistor (e.g., pot).

The compensating reference is delivered to a secondary interface 130 of the dimming driver IC 120.

The valley detection circuitry 140, in some embodiments, comprises a zener diode that is coupled to a microcontroller 145. The valley detection circuitry 140 is configured to sense when the operational reference reaches a pre-set low value (see 25 of FIG. 1), such as a transition from a highest operational reference value (see 20 of FIG. 1) of the AC waveform. Thus, the valley detection circuitry 140 detects when the AV waveform is transitioning into the valley. The valley detection circuitry 140 then determines a suitable compensating reference that counteracts the loss in voltage/current. The microcontroller 145 causes the compensating circuit 115 to output the compensating reference during the valley portion of the AC waveform until the valley detection circuitry 140 no longer detects a valley of the AC waveform.

Figures 3A, 3B:
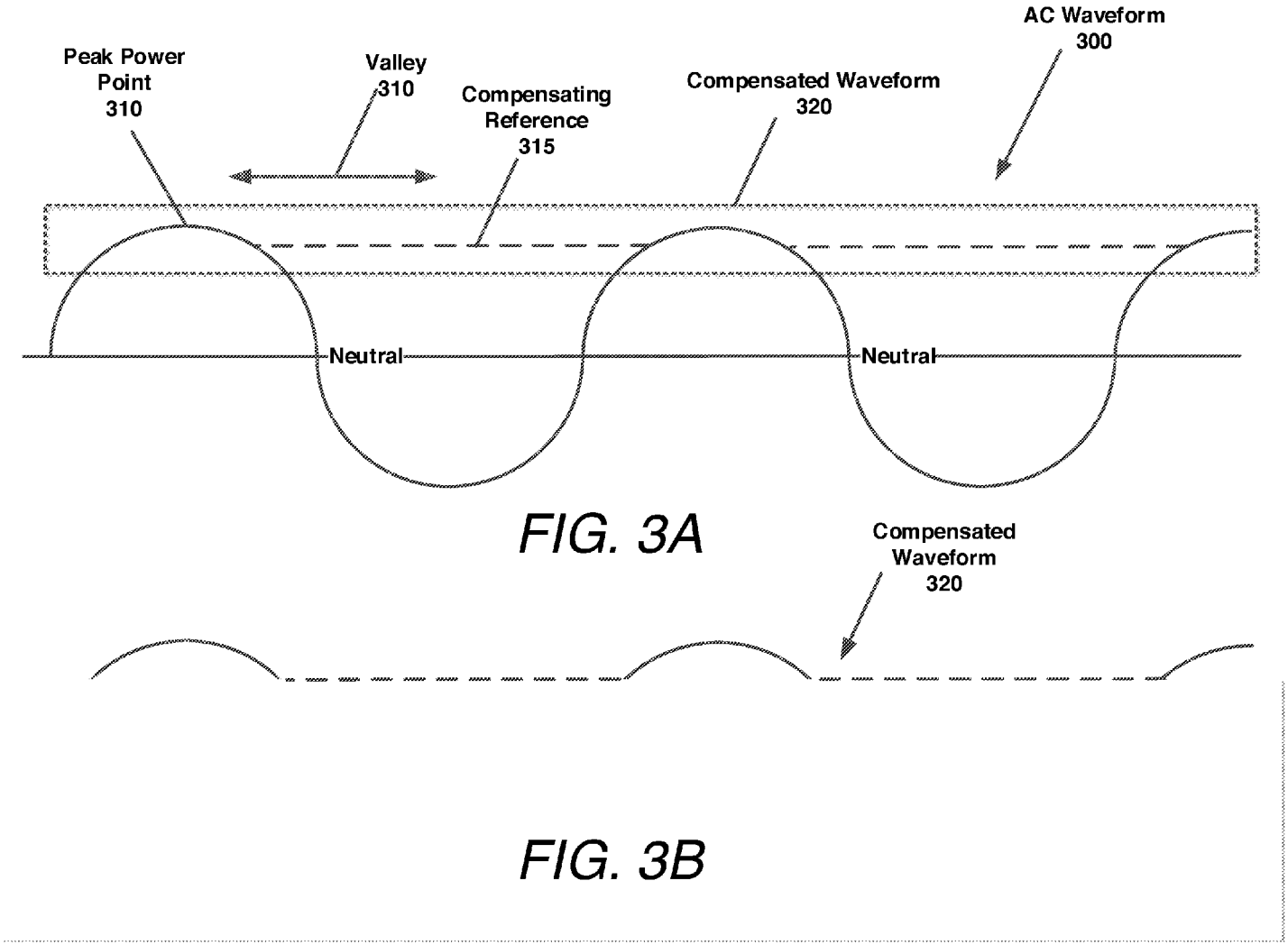
FIG. 3A illustrates the creation of a compensated waveform using a compensating reference that is related to the operational reference of the AC waveform.
FIG. 3B illustrates the compensated waveform.

FIG. 3 illustrates an example compensated AC waveform produced by the dimming driver IC. For example, the AC waveform 300 has a valley 305. When the AC waveform 300 transitions from a peak power point 310 into the valley 305, the valley detection circuitry 140 senses the transition and causes the compensating circuit 115 to output its compensating reference 315. In essence, the compensating reference 315 somewhat flattens out the AC waveform to produce a compensated waveform 320 that is more "flat", reducing or eliminating the drop in voltage/current that would take place naturally in the AC waveform.

In sum, the dimming driver IC 120 used in the present technology comprises and utilizes two separate direct current voltage interfaces, one that receives an operating voltage and one that receives an ancillary or second voltage. In some instances the compensating circuit 115 is configured to connect to an auxiliary power input interface, such as a $V_{CC}$ interface (secondary interface 130) of the diming driver IC 120. Advantageously, providing a secondary voltage to this additional power interface, as well as operating voltage to the main power interface of the dimming driver IC 120 operates to remove any flicker or noise remaining in the output power produced by the dimming driver IC 120. That is, the output voltage provided by the dimming driver IC 120 on an output interface 135 may be coupled to the semiconductor light 125 and cause the semiconductor light 125 to operate at luminance levels ranging from zero to 100%.

Broadly speaking, while the dimming driver IC 120 may remove a significant portion of the flicker caused by compensating for oscillation of the AC waveform, the provision of the compensating reference to the secondary interface 130 produces the unexpected benefit/result of removing noise and purifying the output voltage generated by the dimming driver IC 120. This effect may be particularly advantageous when deep dimming semiconductor power supplies and lights are utilized in older lighting control systems, which may generate noise within the assembly 100. For example, a legacy control panel or mixing board can create noise that affects the performance of an LED light controlled by the legacy system. This noise can be reduced or eliminated with the present technology.

It will be understood that an interface, as used herein, may include a pin or other physical means for coupling a line or wiring with an integrated circuit.

As mentioned above, if the operational reference provided to the IC 100 is lower than what is required to ensure that the power supply 105 remains on consistently, the power supply 105 may turn on and off as the input AC waveform oscillates. This is particularly deleterious in deep dimming power situations as only a small portion of the AV waveform is being utilized (see FIG. 1). To ensure that the power supply 105 remains in operation during deep dimming, a microcontroller 145 may be configured to pre-load the power supply 105 with enough operational reference to ensure that the power supply 105 remains operational, even during deep dimming operation.

Because the power supply 105 has been pre-loaded with an initial voltage or current, a new zero reference for operation of the semiconductor light 125 may be established.

Figure 4:
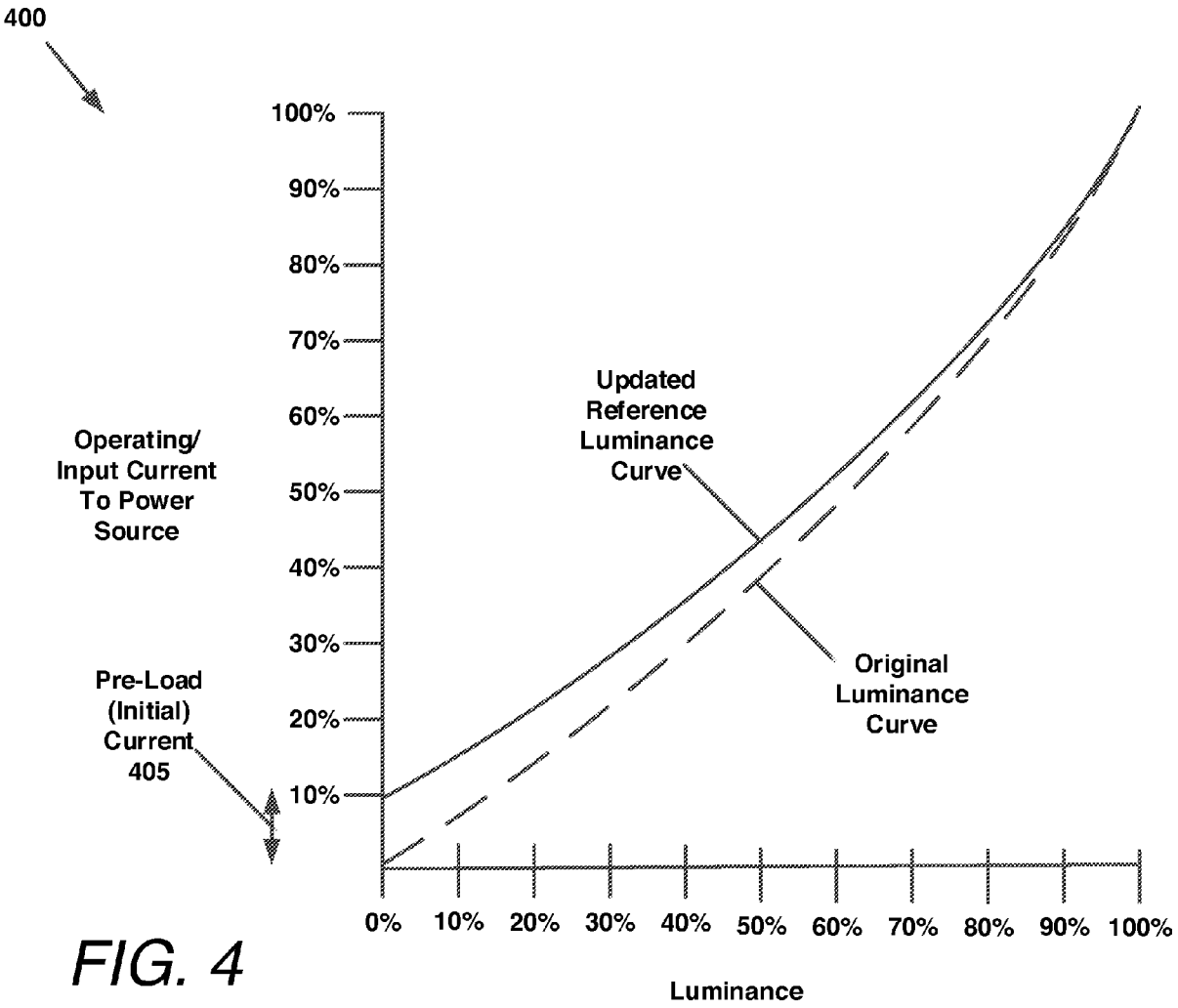
FIG. 4 illustrates the resetting of a dimming or luminance curve for a semiconductor lighting assembly.

The microcontroller 145 may be reset to a zero percent luminance threshold for the semiconductor light 125 that is equal to the pre-load (e.g., initial) current for the IC 100. FIG. 4 illustrates a resetting of a luminance curve 400 for the semiconductor light 125 where a zero luminance is set to 10% input current. More specifically, the vertical axis of the luminance curve 400 includes input current levels that are provided to the power supply 105 of the assembly 100. Again, the power supply 105 is pre-loaded with an initial voltage and/or current 405 that ensures that the power supply 105 will not shut off during use of the assembly 100, even when assembly 100 is in a deep dimming mode. The luminance curve 400 may be utilized by the microcontroller 145 as a comparison for dimming of the assembly 100.

It will be understood that the combination of the output of the compensating circuit 115 delivering a compensating reference, along with a pre-loading of an operational reference by the power supply 105, as well as a resetting of the luminance reference curve for the semiconductor light allows for deep dimming of the semiconductor lighting assembly 100 in such a way that semiconductor light can operate from zero luminance to 100% luminance without inducing flicker in the semiconductor light 125.

The microcontroller 145 is shown as comprising a processor 145A and a memory 145B. The memory 145B may include dimming and control logic that when executed by the processor 145A, causes the microcontroller 145 to perform methods for deep dimming (e.g., from zero lumens to 10+% lumens) of a semiconductor lighting assembly. In some instances, the method may include determining a power level for a power source of a semiconductor light that is required to ensure that the power source is consistently operational regardless of the luminance setting required by the semiconductor light. This power level is referred to as an initial or pre-load current level 405. The microcontroller 145 may be configured to pre-load the power source with an initial voltage and/or current level. Next, the microcontroller 145 may reset a luminance-dimming curve for the semiconductor lighting assembly to ensure that a zero luminance is associated with the pre-load current that was required by the power source. Once this reference is set, the microcontroller 145 will ensure that current delivered to the power source will not fall below the required pre-load current.

Once the luminance dimming curve has been set, the microcontroller 145 may allow infinite dimming (e.g., from zero to 100%) of the semiconductor light, while ensuring that the semiconductor light does not flicker by managing a lowest threshold voltage required by the power source of the assembly. In some instances, the luminance dimming curve may be established on a dimmer, such as a dimmer rack 160, the operation of which would be known to one of ordinary skill in the art. A user may physical dim the semiconductor light using a slider or other physical input device that would also be known to one of ordinary skill in the art. That is, a dimmer slider is coupled with the dimmer rack 160, which provides dimming signals to the semiconductor lighting assembly 100. In some embodiments the microcontroller 145 may logically dim the semiconductor light 125 using, for example, a dimming schema or program that is stored in the memory 145A of the microcontroller 145. This dimming schema may also be based upon the luminance curve established for the semiconductor lighting assembly 100.

In some embodiments, the microcontroller 145 can store dimming schemas that are used to control dimming device ICs that use different forward voltages (e.g., minimum operational reference). The dimming schema matches a forward voltage to a required compensating reference. The microcontroller 145 can control the operation or behavior of the compensating circuit 115 to set the compensating reference. For example, the microcontroller 145 can tune the compensating reference output by the compensating circuit 115 by use of the resistor 130A. For example, the microcontroller 145 can selectively adjust a magnitude of the compensating reference to compensate for flicker in the semiconductor lighting assembly 100.

The resistive properties of the resistor 130A can be changed by the microcontroller 145 to control the discharge of the compensating reference by the capacitor 130B into the dimming driver IC 120.

In some embodiments, the microcontroller 145 may be embodied as an external power source 100A that is coupled with the semiconductor lighting assembly 100, such as dimming rack.

In some instances, the semiconductor lighting assembly 100 may comprise a cooling assembly 150, which provides thermal transfer functionalities to cool the heat generated by the components of the assembly 100. Moreover, because the power supply 105 is capable of outputting much higher power levels (e.g., in excess of 90 watts) than power sources used with common semiconductor lighting assemblies, a single power source may be utilized for each component of the assembly 100.

Advantageously, dimming driver ICs that cycle on and off will generate a tremendous amount of heat due to cycling. The present technology provides the unexpected benefit of controlling heat generation by a semiconductor lighting assembly because the dimming driver ICs 120 do not cycle between on and off positions. The dimming driver ICs of the present technology use valley detection and compensator circuitry to detect valleys in an operational reference and supply a compensating reference to keep the LED from cycling completely off, especially during deep dimming cycles.

Figure 5:
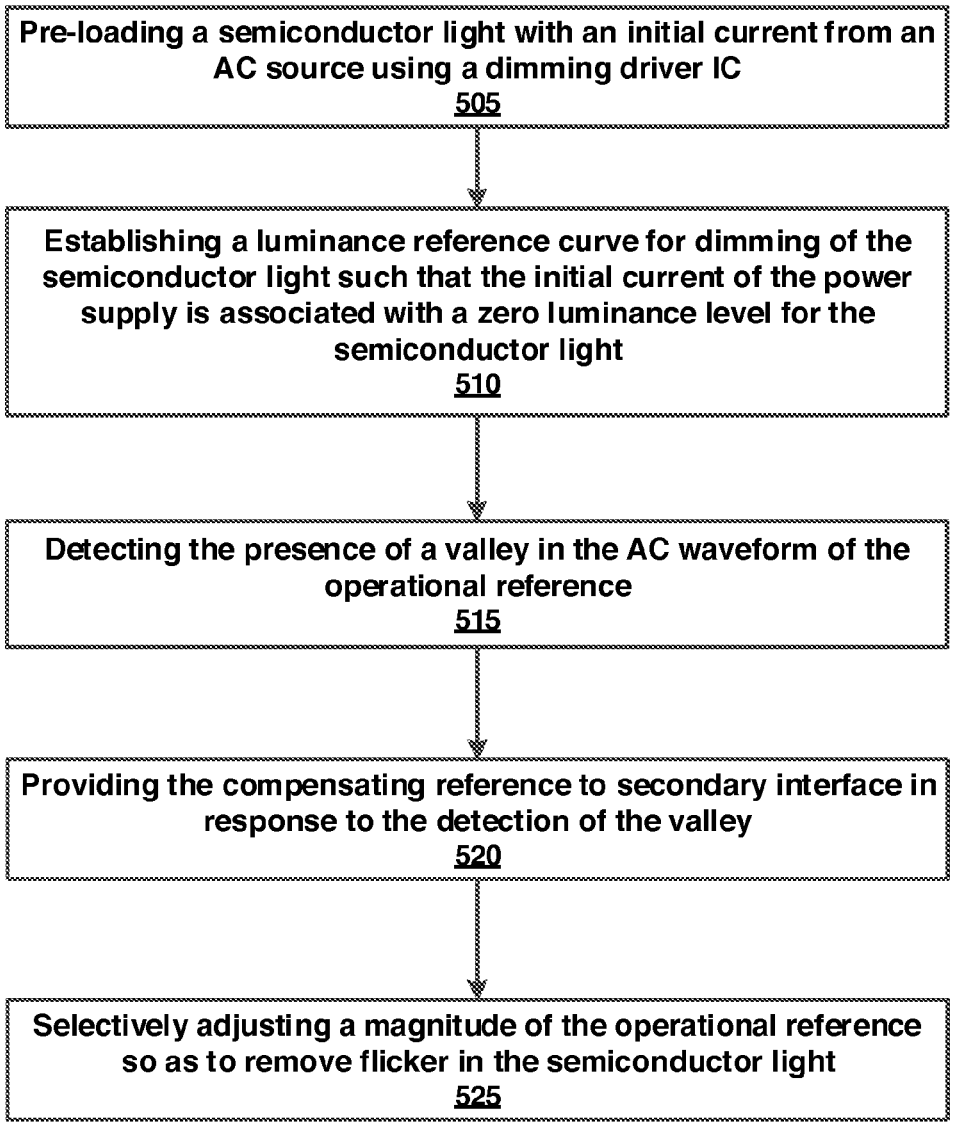
FIG. 5 is a flow chart of an example method for deep dimming a semiconductor lighting assembly.

FIG. 5 is a flowchart of an example method for controlling a semiconductor lighting assembly. The semiconductor lighting assembly comprises a dimming driver IC and associated circuitry for creating a compensated waveform as described above.

In one embodiment, the method comprises pre-loading 505 the semiconductor light assembly with an initial current from an AC source, using a dimming driver IC. Once the semiconductor lighting assembly is powered up and ready for use, the method further comprises establishing 510 a luminance reference curve for dimming of the semiconductor light such that the initial current of the power supply is associated with a zero luminance level for the semiconductor light.

This may include a microcontroller searching for a dimming schema and setting an operational reference value that is based on a known operational reference for the semiconductor light.

Next, the method includes detecting 515 the presence of a valley in the AC waveform of an operational reference. It will be appreciated that a valley will occur numerous times every second as the AC waveform oscillates.

When a valley is detected, the method further comprises providing 520 a compensating reference to a secondary interface of a dimming driver IC in response to the detection of the valley. Again, the compensating reference will "smooth" or "flatten" the AC waveform (see FIG. 3B) to compensate for the detected valley. This compensation reduces or eliminates flicker when the dimming driver IC is operating in a low luminance (e.g., deep dimming) mode. Thus, the compensating reference will prevent the dimming driver IC from cycling (turning on and off) when the operational reference comprises only a small portion, typically zero to ten percent of the AC waveform.

In some embodiments, the method includes selectively adjusting 525 a magnitude of the operational reference so as to remove flicker in the semiconductor light. As mentioned above, this may occur when a resistor and capacitor combination is tuned by a microcontroller to output the compensating reference at a desired level.

Figure 6:
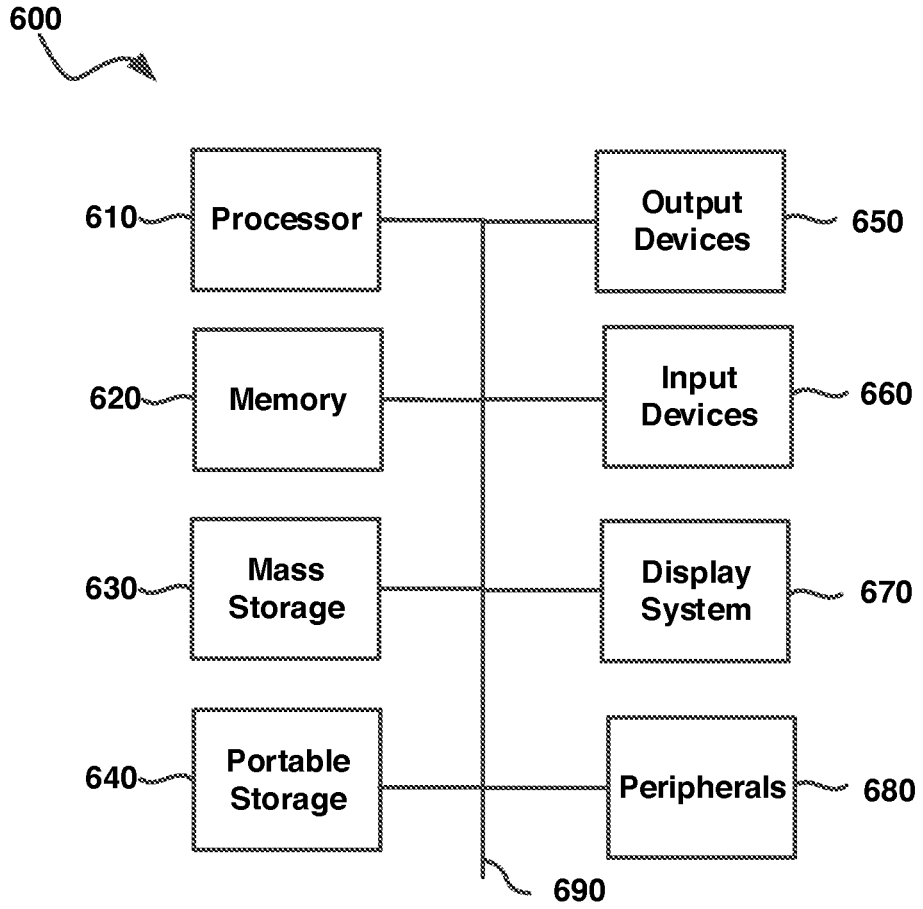
FIG. 6 illustrates an exemplary computing system that may be used to implement embodiments according to the present technology.

FIG. 6 illustrates an exemplary computing device 600 that may be used to implement an embodiment of the present systems and methods. The system 600 of FIG. 6 may be implemented in the contexts of the likes of computing devices, such as an external control system or microcontroller 145 of FIG. 2. The computing device 600 of FIG. 6 includes a processor 610 and main memory 620. Main memory 620 stores, in part, instructions and data for execution by processor 610. Main memory 620 may store the executable code when in operation. The system 600 of FIG. 6 further includes a mass storage device 630, portable storage device 640, output devices 650, user input devices 660, a display system 670, and peripherals 680.

The components shown in FIG. 6 are depicted as being connected via a single bus 690. The components may be connected through one or more data transport means. Processor 610 and main memory 620 may be connected via a local microprocessor bus, and the mass storage device 630, peripherals 680, portable storage device 640, and display system 670 may be connected via one or more input/output (I/O) buses.

Mass storage device 630, which may be implemented with a magnetic disk drive or an optical disk drive, is a non-volatile storage device for storing data and instructions for use by processor 610. Mass storage device 630 can store the system software for implementing embodiments of the present technology for purposes of loading that software into main memory 620.

Portable storage device 640 operates in conjunction with a portable non-volatile storage medium, such as a floppy disk, compact disk or digital video disc, to input and output data and code to and from the computing system 600 of FIG. 6. The system software for implementing embodiments of the present technology may be stored on such a portable medium and input to the computing system 600 via the portable storage device 640.

Input devices 660 provide a portion of a user interface. Input devices 660 may include an alphanumeric keypad, such as a keyboard, for inputting alphanumeric and other information; or a pointing device, such as a mouse, a trackball, stylus, or cursor direction keys. Additionally, the system 600 as shown in FIG. 6 includes output devices 650. Suitable output devices include speakers, printers, network interfaces, and monitors.

Display system 670 may include a liquid crystal display (LCD) or other suitable display device. Display system 670 receives textual and graphical information, and processes the information for output to the display device.

Peripherals 680 may include any type of computer support device to add additional functionality to the computing system. Peripherals 680 may include a modem or a router.

The components contained in the computing system 600 of FIG. 6 are those typically found in computing systems that may be suitable for use with embodiments of the present technology and are intended to represent a broad category of such computer components that are well known in the art. Thus, the computing system 600 can be a personal computer, hand held computing system, telephone, mobile computing system, workstation, server, minicomputer, mainframe computer, or any other computing system. The computer can also include different bus configurations, networked platforms, multi-processor platforms, etc. Various operating systems can be used including UNIX, Linux, Windows, Macintosh OS, Palm OS, and other suitable operating systems.

Some of the above-described functions may be composed of instructions that are stored on storage media (e.g., computer-readable medium). The instructions may be retrieved and executed by the processor. Some examples of storage media are memory devices, tapes, disks, and the like. The instructions are operational when executed by the processor to direct the processor to operate in accordance with the technology. Those skilled in the art are familiar with instructions, processor(s), and storage media.

It is noteworthy that any hardware platform suitable for performing the processing described herein is suitable for use with the technology. The terms "computer-readable storage medium" and "computer-readable storage media" as used herein refer to any medium or media that participate in providing instructions to a CPU for execution. Such media can take many forms, including, but not limited to, non-volatile media, volatile media and transmission media. Non-volatile media include, for example, optical or magnetic disks, such as a fixed disk. Volatile media include dynamic memory, such as system RAM. Transmission media include coaxial cables, copper wire and fiber optics, among others, including the wires that comprise one embodiment of a bus. Transmission media can also take the form of acoustic or light waves, such as those generated during radio frequency (RF) and infrared (IR) data communications. Common forms of computer-readable media include, for example, a floppy disk, a flexible disk, a hard disk, magnetic tape, any other magnetic medium, a CD-ROM disk, digital video disk (DVD), any other optical medium, any other physical medium with patterns of marks or holes, a RAM, a PROM, an EPROM, an EEPROM, a FLASHEPROM, any other memory chip or data exchange adapter, a carrier wave, or any other medium from which a computer can read.

Various forms of computer-readable media may be involved in carrying one or more sequences of one or more instructions to a CPU for execution. A bus carries the data to system RAM, from which a CPU retrieves and executes the instructions. The instructions received by system RAM can optionally be stored on a fixed disk either before or after execution by a CPU.

Computer program code for carrying out operations for aspects of the present technology may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The corresponding structures, materials, acts, and equivalents of all means or step plus function elements in the claims below are intended to include any structure, material, or act for performing the function in combination with other claimed elements as specifically claimed. The description of the present technology has been presented for purposes of illustration and description, but is not intended to be exhaustive or limited to the invention in the form disclosed. Many modifications and variations will be apparent to those of ordinary skill in the art without departing from the scope and spirit of the invention. Exemplary embodiments were chosen and described in order to best explain the principles of the present technology and its practical application, and to enable others of ordinary skill in the art to understand the invention for various embodiments with various modifications as are suited to the particular use contemplated.

Aspects of the present technology are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present technology. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. An infinitely dimmable semiconductor lighting assembly, the assembly comprising:

dimming driver integrated circuit (IC) that is configured to compensate for flicker in a semiconductor light caused by alternating current (AC) waveform valleys of an operational reference provided by an AC source, the dimming driver IC comprising: a main interface and a secondary interface, the main interface receiving the operational reference, the secondary interface receiving a compensating reference which is relative to the operational reference, the dimming driver IC using both the operational reference and the compensating reference to create a compensated waveform that drives the semiconductor light while removing flicker at any luminance level;

a dimming interface that receives dimming input signals ranging from zero percent lumens to 100 percent lumens of the semiconductor light, the semiconductor light coupled with the dimming driver IC via an output interface of the dimming driver IC; and the dimming driver IC being configured to selectively and infinitely control illumination of the semiconductor light from between zero percent lumens to 100 percent lumens, in response to the dimming input signals, in such a way that no flicker is produced by the semiconductor light.

2. The assembly according to claim 1, wherein the operational reference is a minimum voltage required to power the dimming driver IC.

3. The assembly according to claim 1, wherein the dimming driver IC further comprises:

a valley detection circuit that detects the waveform valleys; and a compensating circuit that outputs the compensating reference in response to detection of the waveform valleys by the valley detection circuit.

4. The assembly according to claim 3, further comprising a microcontroller comprising a processor and memory for storing executable instructions, the processor executing the instructions to pre-load dimming driver IC with an initial current that ensures that the dimming driver IC remains operational during deep dimming.

5. The assembly according to claim 4, wherein the processor is further configured to set a zero percent luminance threshold for the dimming driver IC that is equal to the initial current.

6. The assembly according to claim 5, wherein the processor is further configured to determine a power level for the dimming driver IC that is required to ensure that the dimming driver IC is consistently operational regardless of a luminance setting of the semiconductor light.

7. The assembly according to claim 6, wherein the processor further resets a dimming curve for the semiconductor light using a percent availability of the AC waveform.

8. The assembly according to claim 7, wherein the memory further stores a dimming schema that is used to selectively dim the semiconductor light using a pre-selected dimming curve.

9. The assembly according to claim 1, further comprising a cooling module that controls a temperature of the semiconductor lighting assembly, the AC source powering both the semiconductor light and the cooling module.

10. The assembly according to claim 6, wherein the dimming interface is coupled to a dimmer rack is used generate the dimming input signals.

11. The assembly according to claim 6, wherein the dimmer rack introduces noise into the dimming input signals, the noise being canceled by the compensating reference.

12. The assembly according to claim 1, wherein the compensating reference is equal to the operational reference and in-phase relative to the operational reference.

13. A method for deep dimming of a semiconductor light, the method comprising:

pre-loading a semiconductor light with an initial current from an AC source, wherein the semiconductor light includes:

a dimming driver integrated circuit (IC) that is configured to compensate for flicker in the semiconductor light caused by alternating current (AC) waveform valleys of an operational reference provided by the AC source, the dimming driver IC comprising: a main interface and a secondary interface, the main interface receiving the operational reference, the secondary interface receiving a compensating reference which is relative to the operational reference, the dimming driver IC using both the operational reference and the compensating reference to create a compensated waveform that drives the semiconductor light while removing flicker at any luminance level;

establishing a luminance reference curve for dimming of the semiconductor light such that the initial current of the power supply is associated with a zero luminance level for the semiconductor light; and outputting signals by the dimming driver integrated circuit that cause the semiconductor light to emit light at any luminance within a range between 0% luminance and 10% luminance, inclusive, without inducing flickering of the semiconductor light.

14. The method according to claim 13, wherein the initial current is a minimum value required to power the dimming driver module.

15. The method according to claim 14, further comprising detecting a power level for the power source that is required to ensure that the dimming driver module is consistently operational regardless of a luminance setting of the semiconductor light.

16. The method according to claim 15, further comprising resetting a dimming curve for the semiconductor light using the initial current.

17. The method according to claim 16, further comprising:

detecting the presence of a valley in the AC waveform of the operational reference; and providing the compensating reference to secondary interface in response to the detection of the valley.

18. The method according to claim 17, further comprising selectively adjusting a magnitude of the operational reference so as to remove flicker in the semiconductor light.

* * * * *